US012044419B1

(12) United States Patent
DeLoach et al.

(10) Patent No.: US 12,044,419 B1
(45) Date of Patent: Jul. 23, 2024

(54) HVAC SYSTEM WITH COIL ARRANGEMENT IN BLOWER UNIT

(71) Applicants: Richard Zane DeLoach, Wentzville, MO (US); David Hull, Seattle, WA (US); Mohammed Aliakbari Miyanmahaleh, Dallas, TX (US); Taylor Michael Keep, Berkeley, CA (US)

(72) Inventors: Richard Zane DeLoach, Wentzville, MO (US); David Hull, Seattle, WA (US); Mohammed Aliakbari Miyanmahaleh, Dallas, TX (US); Taylor Michael Keep, Berkeley, CA (US)

(73) Assignee: KOVA Comfort, Inc., Carrollton, TX (US)

( * ) Notice: Subject to any disclaimer, the term of this patent is extended or adjusted under 35 U.S.C. 154(b) by 364 days.

(21) Appl. No.: 16/733,716

(22) Filed: Jan. 3, 2020

Related U.S. Application Data

(60) Provisional application No. 62/788,342, filed on Jan. 4, 2019, provisional application No. 62/788,350, filed
(Continued)

(51) Int. Cl.
*F28F 13/06* (2006.01)
*F24F 1/00* (2019.01)
(Continued)

(52) U.S. Cl.
CPC ..... *F24F 1/0059* (2013.01); *F24F 1/0011* (2013.01); *F24F 1/0057* (2019.02);
(Continued)

(58) Field of Classification Search
CPC ..... F24F 1/0011; F24F 1/0057; F24F 1/0059; F28F 1/126; F28F 1/128; F28F 2250/102; F28F 13/06
See application file for complete search history.

(56) References Cited

U.S. PATENT DOCUMENTS 2,096,271 A 10/1937 Young
2,612,095 A 9/1952 Kennedy
(Continued)

FOREIGN PATENT DOCUMENTS

CN 104465638 3/2015
CN 108369039 B 7/2020
(Continued)

OTHER PUBLICATIONS

Non-Final Office Action mailed on Feb. 25, 2020, U.S. Appl. No. 16/250,727, filed Jan. 17, 2019, applicant: Juntao Zhang, 21 pages.
(Continued)

*Primary Examiner* — Jerry-Daryl Fletcher
*Assistant Examiner* — Daniel C Comings
(74) *Attorney, Agent, or Firm* — Haverstock & Owens, A Law Corporation

(57) ABSTRACT

An HVAC system includes a front side access panel, an HVAC unit, a mounting sleeve, and a back side grille. The mounting sleeve and the HVAC unit are configured to fit within the preexisting framing of a building, and in particular to be mounted in a wall, between pre-existing studs, of a room. The HVAC unit includes an evaporator section, a mechanical section, and a condenser section. The HVAC system is optimized to maximize space utilization and support efficient installation and servicing while minimizing product intrusion into living space. The evaporator section includes a heat exchanger, an air mover, and electrical circuitry. The air mover and the heat exchanger can have a
(Continued)

variety of different configurations, all designed for implementation within the limited confines between preexisting studs of the wall. The heat exchanger can include a coil assembly having an evaporator coil and a plurality of fins.

16 Claims, 8 Drawing Sheets

Related U.S. Application Data on Jan. 4, 2019, provisional application No. 62/788,334, filed on Jan. 4, 2019, provisional application No. 62/788,314, filed on Jan. 4, 2019.

(51) Int. Cl.
*F24F 1/0011* (2019.01)
*F24F 1/0057* (2019.01)
*F24F 1/0059* (2019.01)
*F28F 1/12* (2006.01)

(52) U.S. Cl.
CPC ..... *F28F 1/126* (2013.01); *F28F 13/06* (2013.01); *F28F 2250/102* (2013.01)

(56) References Cited

U.S. PATENT DOCUMENTS

| | | | | |
|---|---|---|---|---|
| 2,658,440 | A | 11/1953 | Lange | |
| 3,063,357 | A | 11/1962 | Eberhart | |
| 3,623,419 | A | 11/1971 | Taylor | |
| 3,703,141 | A | 11/1972 | Pernoud | |
| 3,742,725 | A * | 7/1973 | Berger | F24F 1/035 62/298 |
| 3,877,356 | A | 4/1975 | Bruns | |
| 3,908,750 | A * | 9/1975 | Siegel | F24F 1/0057 165/265 |
| 4,657,070 | A * | 4/1987 | Kluppel | F28B 1/06 165/110 |
| 4,805,418 | A * | 2/1989 | Ishizuka | F24F 1/0014 165/122 |
| 5,115,616 | A | 5/1992 | Nixon | |
| 5,255,532 | A | 10/1993 | Chae | |
| 5,301,744 | A | 4/1994 | Derks | |
| 5,396,779 | A | 3/1995 | Voss | |
| 5,857,343 | A * | 1/1999 | Cho | F24F 1/005 62/131 |
| 5,918,666 | A * | 7/1999 | Chin | F24F 13/22 165/122 |
| 6,371,637 | B1 | 4/2002 | Atchinson | |
| 6,574,975 | B2 * | 6/2003 | Bourne | F28C 1/04 62/171 |
| 6,701,741 | B2 * | 3/2004 | Liu | F24F 13/20 62/429 |
| 9,011,216 | B1 | 4/2015 | Al-Alusi | |
| 9,086,226 | B2 | 7/2015 | Bauer | |
| 9,429,923 | B2 | 8/2016 | Ward | |
| 9,519,874 | B2 | 12/2016 | Macek | |
| 9,772,116 | B2 | 9/2017 | Hester | |
| 9,869,484 | B2 | 1/2018 | Hester et al. | |
| 9,933,177 | B2 | 4/2018 | Hester et al. | |
| 10,094,586 | B2 | 10/2018 | Pavlovski | |
| 10,136,549 | B2 | 11/2018 | Steiner | |
| 10,571,414 | B2 | 2/2020 | Turner | |
| 10,708,077 | B2 | 7/2020 | Cui | |
| 11,098,921 | B2 | 8/2021 | Ellis | |
| 11,143,423 | B2 | 10/2021 | Li | |
| 11,156,572 | B2 | 10/2021 | Buda | |
| 2004/0007981 | A1 | 1/2004 | Shibata | |
| 2006/0099904 | A1 | 5/2006 | Belt | |
| 2007/0138307 | A1 | 6/2007 | Khoo | |
| 2010/0071868 | A1 * | 3/2010 | Reifel | B23P 15/26 165/47 |
| 2010/0141153 | A1 | 6/2010 | Recker | |
| 2010/0262298 | A1 | 10/2010 | Johnson | |
| 2011/0227489 | A1 | 9/2011 | Huynh | |
| 2012/0162965 | A1 | 6/2012 | Takeuchi | |
| 2012/0259469 | A1 | 10/2012 | Ward | |
| 2012/0299489 | A1 | 11/2012 | Sakuragi | |
| 2013/0173064 | A1 | 7/2013 | Fadell | |
| 2014/0087158 | A1 | 3/2014 | Ciuperca | |
| 2014/0175996 | A1 | 6/2014 | Yoon | |
| 2014/0249876 | A1 | 9/2014 | Wu | |
| 2014/0260034 | A1 | 9/2014 | Ciuperca | |
| 2015/0043212 | A1 | 2/2015 | Coffey | |
| 2015/0204600 | A1 | 7/2015 | Fay | |
| 2016/0123619 | A1 | 5/2016 | Hester | |
| 2016/0201933 | A1 | 7/2016 | Hester | |
| 2016/0201934 | A1 | 7/2016 | Hester | |
| 2016/0223214 | A1 | 8/2016 | Turner | |
| 2016/0223216 | A1 | 8/2016 | Buda | |
| 2016/0305678 | A1 | 10/2016 | Pavlovski | |
| 2016/0034137 | A1 | 11/2016 | Dekker | |
| 2017/0003039 | A1 * | 1/2017 | Lazzari | F24F 1/0063 |
| 2017/0074534 | A1 | 3/2017 | Turner | |
| 2017/0138542 | A1 | 5/2017 | Gielen | |
| 2017/0146261 | A1 | 5/2017 | Rogers et al. | |
| 2018/0004172 | A1 | 1/2018 | Patel | |
| 2018/0202678 | A1 | 7/2018 | Ahuja | |
| 2018/0206414 | A1 | 7/2018 | Goodman | |
| 2018/0335220 | A1 | 11/2018 | Matambo | |
| 2018/0363893 | A1 | 12/2018 | Cheng | |
| 2019/0078801 | A1 | 3/2019 | Turney et al. | |
| 2019/0103182 | A1 | 4/2019 | Borshch | |
| 2019/0120438 | A1 | 4/2019 | Wan | |
| 2019/0158305 | A1 | 5/2019 | Cui | |
| 2019/0166661 | A1 | 5/2019 | Gao | |
| 2019/0309975 | A1 | 10/2019 | Salem | |
| 2019/0338974 | A1 | 11/2019 | Turney | |
| 2019/0338975 | A1 | 11/2019 | Ray | |
| 2019/0353378 | A1 | 11/2019 | Ramamurti | |
| 2019/0353384 | A1 | 11/2019 | Laughman | |
| 2019/0360711 | A1 | 11/2019 | Sohn | |
| 2020/0088427 | A1 | 3/2020 | Li | |
| 2020/0256581 | A1 | 8/2020 | Weng | |
| 2020/0355391 | A1 | 11/2020 | Wenzel | |
| 2021/0011443 | A1 | 1/2021 | McNamara | |
| 2021/0018205 | A1 | 1/2021 | Ellis | |
| 2021/0018211 | A1 | 1/2021 | Ellis | |
| 2021/0025617 | A1 | 1/2021 | Hamada | |
| 2021/0055011 | A1 | 2/2021 | Smith | |
| 2021/0102722 | A1 | 4/2021 | Nabi | |
| 2021/0140660 | A1 | 5/2021 | Kogo | |
| 2021/0140671 | A1 | 5/2021 | Francis | |
| 2021/0173366 | A1 | 6/2021 | Turney | |
| 2021/0191348 | A1 | 6/2021 | Lee | |
| 2021/0270487 | A1 | 9/2021 | Salem | |
| 2021/0285671 | A1 | 9/2021 | Du | |
| 2021/0325072 | A1 | 10/2021 | Lin | |
| 2021/0364181 | A1 | 11/2021 | Risbeck | |

FOREIGN PATENT DOCUMENTS

| | | | |
|---|---|---|---|
| JP | 3608500 | B2 | 1/2005 |
| JP | 3686195 | B2 | 8/2005 |
| JP | 2008215807 | A | 9/2008 |
| JP | 2015094558 | A | 5/2015 |
| JP | 2019113214 | A | 7/2019 |

OTHER PUBLICATIONS

Notice of Allowance dated Jun. 11, 2019, U.S. Appl. No. 16/197,003, filed Jan. 20, 2018, Applicant: Shanfu Gao, 15 pages.

Liu, Weiwei, Zhiwei Lian and Bo Zhao. "A neural network evaluation model for individual thermal comfort." Energy and Buildings 39.10 (2007): 1115-1122. (Year: 2007).

* cited by examiner

HVAC SYSTEM WITH COIL ARRANGEMENT IN BLOWER UNIT

RELATED APPLICATIONS

This patent application claims priority under 35 U.S.C. 119(e) of the U.S. provisional patent application, Application Ser. No. 62/788,314, filed on Jan. 4, 2019, and entitled "HVAC Control System", U.S. provisional patent application, Application Ser. No. 62/788,334, filed on Jan. 4, 2019, and entitled "HVAC System with Modular Architecture", U.S. provisional patent application, Application Ser. No. 62/788,342, filed on Jan. 4, 2019, and entitled "HVAC System with Single Piece Body", U.S. provisional patent application, Application Ser. No. 62/788,350, filed on Jan. 4, 2019, and entitled "HVAC System with Coil Arrangement in Blower Unit", which are each hereby incorporated in their entireties by reference.

FIELD OF THE INVENTION

The present invention is generally directed to a HVAC (Heating, Ventilating, and Air Conditioning) system. More specifically, the present invention is directed to an HVAC system with a coil arrangement in a blower unit.

BACKGROUND OF THE INVENTION

An air conditioning system typically includes an evaporator coil, a condenser, an accumulator, a condensor, and a metering device. The components are interconnected by pipes or tubing, and separate fans move air across the evaporator coil and the condenser. A refrigerant is in various phases as it flows through the air conditioning components. Circulating refrigerant vapor enters the compressor and is compressed to a higher pressure, resulting in a higher temperature as well. The compressed refrigerant vapor is now at a temperature and pressure at which it can be condensed and is routed through the condenser. In the condenser, the compressed refrigerant vapor flows through condenser coils. A condenser fan blows air across the condenser coils thereby transferring heat from the compressed refrigerant vapor to the flowing air. Cooling the compressed refrigerant vapor condenses the vapor into a liquid. The condensed refrigerant liquid is output from the condenser to the accumulator where the condensed refrigerant liquid is pressurized. The condensed and pressurized refrigerant liquid is output from the accumulator and routed through the metering device where it undergoes an abrupt reduction in pressure. That pressure reduction results in flash evaporation of a part of the liquid refrigerant, lowering its temperature. The cold refrigerant liquid/vapor is then routed through the evaporator coil. The result is a mixture of liquid and vapor at a lower temperature and pressure. The cold refrigerant liquid-vapor mixture flows through the evaporator coil and is completely vaporized by cooling the surface of the evaporator coil and cooling air moving across the evaporator coil surface. The resulting refrigerant vapor returns to the compressor to complete the cycle.

In a single family unit, certain components of the air conditioning system are located inside the house and other components are located outside, for example the condenser and condenser fan are located outside the house and the remaining components are located inside. Typically, the inside components are co-located with the furnace, related air moving components, and air ducts associated with the house's HVAC system. However, in multi family units, such as apartment or condominium complexes, separate positioning of the air conditioning components both inside and outside of each unit is not always feasible. Integrated, box-like, air conditioning units are often used. Such units can be mounted in windows or custom sized wall openings, with a portion of the unit extending into the living area and another portion extending outside beyond an outer wall of the dwelling.

SUMMARY OF THE INVENTION

Embodiments are directed to an HVAC system that includes a front side access panel, an HVAC unit, a mounting sleeve, and a back side grille. The mounting sleeve and the HVAC unit are configured to fit within the preexisting framing of a building, and in particular to be mounted in a wall, between pre-existing studs, of a room. The HVAC unit can be installed into the mounting sleeve via quick connect mechanisms including, but not limited to, snap in connections and/or tab and slot features. The mounting sleeve enables rapid installation and also condensate collection. The HVAC unit includes an evaporator section, a mechanical section, and a condenser section that can be integrally formed as a single physical unit or can be discrete modular units that are assembled together. The design of the HVAC system is optimized to maximize space utilization and support efficient installation and servicing while minimizing product intrusion into living space. The HVAC system includes vertically oriented HVAC components and component connections that are self-aligned. The evaporator section includes a heat exchanger, an air mover, and electrical circuitry. The air mover is also referred to as a blower unit or a fan. Embodiments are directed to the air mover and the heat exchanger having a variety of different configurations, all designed for implementation within the limited confines between preexisting studs of the wall. In some embodiments, the heat exchanger includes a coil assembly having an evaporator coil and a plurality of fins.

In an aspect, a heat exchanging system is disclosed that includes a housing, a heat exchanger, and an air mover. The housing has an input air opening and an output air opening. The heat exchanger is positioned within the housing, wherein the heat exchanger is configured to transfer heat between air flowing by the heat exchanger and fluid flowing within the heat exchanger. The heat exchanger is positioned at an angle relative to the housing. The air mover is positioned within the housing and aligned in a stacked position relative to the heat exchanger. In some embodiments, the heat exchanger comprises a coil and fin assembly. In some embodiments, the coil and fin assembly comprises one or more microchannel tubes and a plurality of fins mechanically connected to the one or more microchannel tubes. In some embodiments, each of the plurality of fins is asymmetrically aligned with the one or more microchannel tubes. In some embodiments, according to the asymmetrical alignment, air passes through the heat exchanger at a non-perpendicular angle to the one or more microchannel tubes. In some embodiments, the heat exchanging system further comprises a mounting sleeve configured to fit within a preexisting framework of a dwelling. In some embodiments, the housing is positioned entirely within a volume enclosed by the mounting sleeve. In some embodiments, the heat exchanger is positioned at a non-parallel angle relative to a height of the housing and is positioned at a non-parallel angle relative to a depth of the housing. In some embodiments, the housing has a depth of between 2 and 6 inches.

In some embodiments, the heat exchanging system further comprises interconnecting refrigerant tubing coupled to the heat exchanger.

In another aspect, another heat exchanging system is disclosed that includes a housing, a heat exchanger, and an air mover. The housing has an input air opening and an output air opening. The heat exchanger is positioned within the housing, wherein the heat exchanger is configured to transfer heat between air flowing by the heat exchanger and fluid flowing within the heat exchanger. The air mover is positioned within the housing and aligned adjacent to the heat exchanger along a lengthwise direction of the heat exchanger. In some embodiments, the heat exchanger is positioned parallel to the lengthwise direction of the housing. In some embodiments, the heat exchanger is positioned at an angle relative to the lengthwise direction of the housing. In some embodiments, the heat exchanger comprises a coil and fin assembly. In some embodiments, the coil and fin assembly comprises one or more microchannel tubes and a plurality of fins mechanically connected to the one or more microchannel tubes. In some embodiments, the heat exchanging system further comprises a mounting sleeve configured to fit within a preexisting framework of a dwelling. In some embodiments, the housing is positioned entirely within a volume enclosed by the mounting sleeve. In some embodiments, the mounting sleeve includes a back side opening in a back side wall, further wherein the heat exchanging system further comprises a first balancing damper positioned within the back side opening, wherein the heat exchanging system further comprises a second balancing damper positioned within the housing and proximate the input air opening. In some embodiments, the housing has a depth of between 2 and 6 inches. In some embodiments, the heat exchanging system further comprises interconnecting refrigerant tubing coupled to the heat exchanger.

BRIEF DESCRIPTION OF THE DRAWINGS

Several example embodiments are described with reference to the drawings, wherein like components are provided with like reference numerals. The example embodiments are intended to illustrate, but not to limit, the invention. The drawings include the following figures.

DETAILED DESCRIPTION OF THE EMBODIMENTS

Embodiments of the present application are directed to an HVAC system. Those of ordinary skill in the art will realize that the following detailed description of the HVAC system is illustrative only and is not intended to be in any way limiting. Other embodiments of the HVAC system will readily suggest themselves to such skilled persons having the benefit of this disclosure.

Reference will now be made in detail to implementations of the HVAC system as illustrated in the accompanying drawings. The same reference indicators will be used throughout the drawings and the following detailed description to refer to the same or like parts. In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application and business related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1:
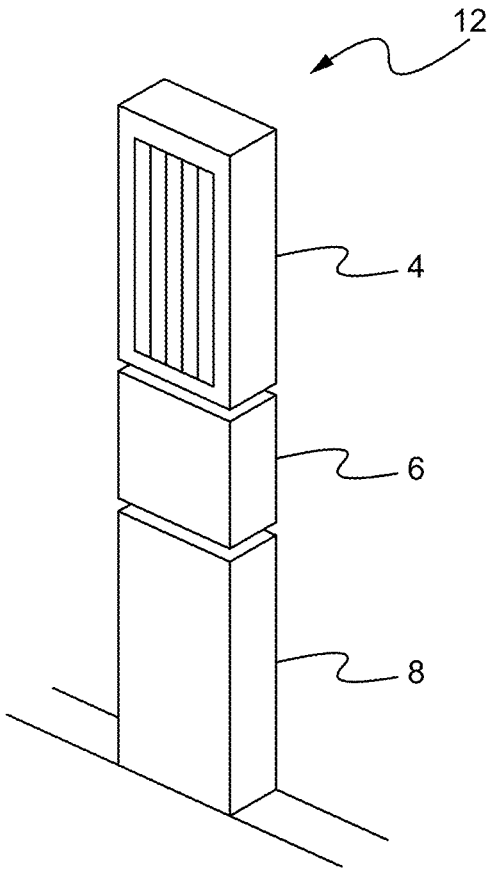
FIG. 1 illustrates a perspective view of the HVAC unit as assembled according to some embodiments.

FIG. 1 illustrates a perspective view of the HVAC unit 12 as assembled according to some embodiments. In some embodiments, the HVAC unit 12 is installed within the preexisting framing of a wall, although as shown in FIG. 1 this framing is removed to better illustrated the HVAC unit as assembled. The HVAC unit 12 includes three sub-assemblies: an indoor air cycling section 4, a mechanical section 6, and an outdoor air cycling section 8. The indoor air cycling section, or simply "indoor section", cycles air from an interior area of a dwelling (indoors) and back out to the interior area. The outdoor air cycling section, or simply "outdoor section", cycles air from an area exterior to the dwelling (outdoors) and back out to the exterior area. In an application where air conditioning cooling is performed, the indoor section functions as an evaporator section, and the outdoor section functions as a condenser section. Subsequent discussion is directed to air conditioning cooling and therefore reference is made to an evaporator section and a condenser section. It is understood that the HVAC unit also can be used for heating, in which case the functionality of the indoor section and the outdoor section can be reversed from that described regarding an evaporator section and a condenser section. Although subsequent description is directed to an evaporator section and a condenser section, it is understood that such description can be generally applied to an indoor section and an outdoor section that performs a heating function. The evaporator section 4 includes a heat exchanger, an air mover, and electrical circuitry. In some embodiments, the heat exchanger includes an evaporator coil assembly and interconnecting refrigerant tubing. In some embodiments, the air mover includes a motor and a fan. In some embodiments, the electrical circuitry includes power wiring, control wiring, and control/diagnostic sensors. The mechanical section 6 includes refrigerant loop components, in-line components, and electrical circuitry. In some embodiments, the refrigerant loop components include a compressor and a metering device, such as an electronic expansion valve. In some embodiments, the in-line components include one or more valves, one or more filters, and interconnecting refrigerant tubing. In some embodiments, the electrical circuitry of the mechanical section includes HVAC unit controls, electrical components, power wiring, control wiring, and control/diagnostics sensors. The condenser section 8 includes a heat exchanger, an air mover, an auxiliary heating component, air quality components, and electrical circuitry. In some embodiments, the heat exchanger of the condenser section includes a condenser coil and interconnecting refrigerant tubing. The condenser section can also include an accumulator. In some embodiments, the air mover in the condenser section includes a motor and a fan. In some embodiments, the auxiliary heating component includes one or more resistive heating elements. In some embodiments, the air quality components include an air filter and ventilation components. In the some embodiments, the electrical circuitry of the condenser section includes power wiring, control wiring, and control/diagnostic sensors.

Figure 2:
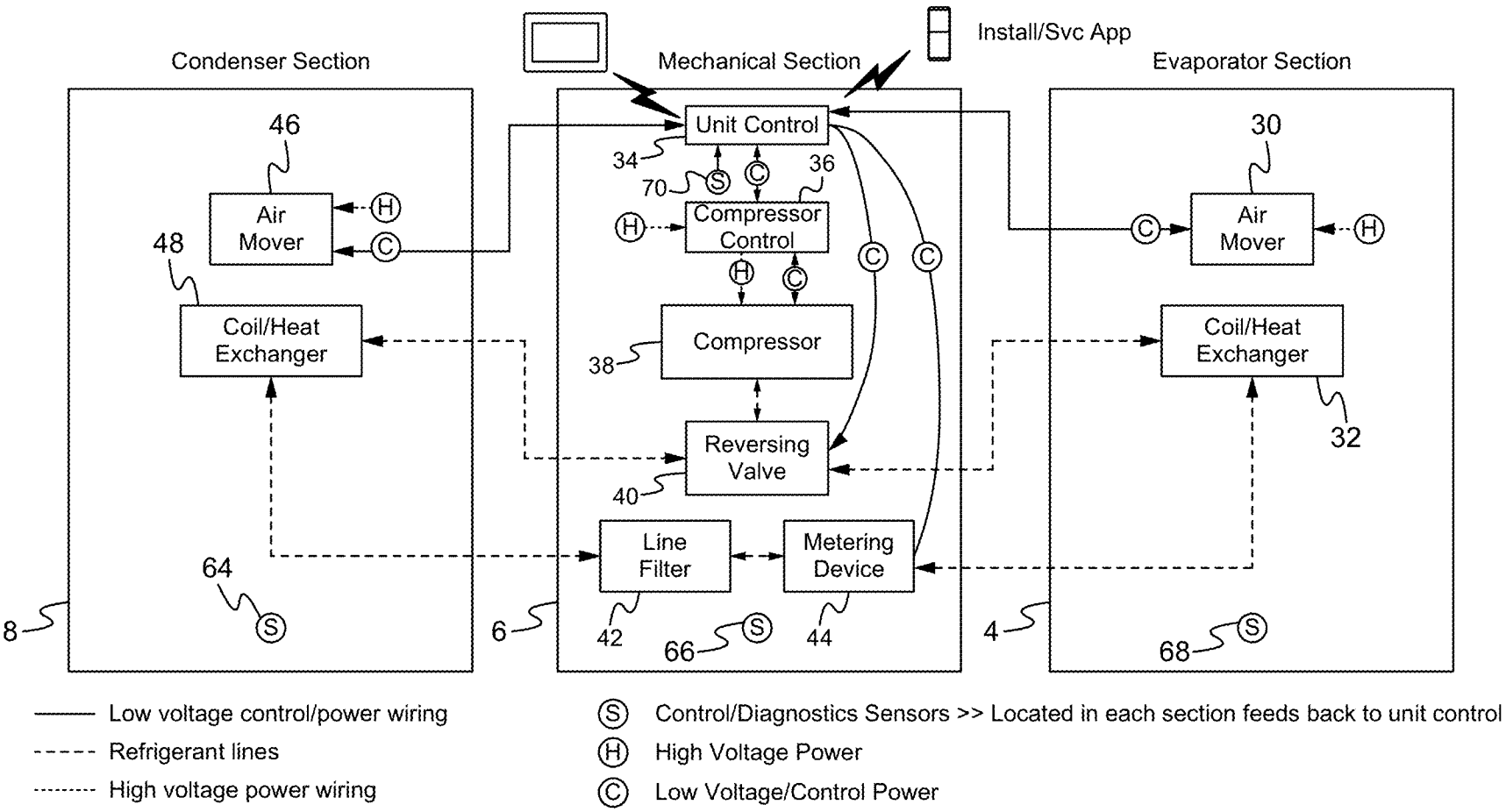
FIG. 2 illustrates a schematic block diagram of the HVAC unit and constituent components corresponding to air conditioning functionality according to some embodiments.

FIG. 2 illustrates a schematic block diagram of the HVAC unit 12 and constituent components corresponding to air conditioning functionality according to some embodiments. A heat exchanger 32 including an evaporator coil assembly in the evaporator section 4 is coupled to a compressor 38 via interconnecting refrigerant tubing and one or more valves 40. The compressor 38 is coupled to a heat exchanger 48 including a condenser coil in the condenser section 8 via interconnecting refrigerant tubing and the one or more valves 40. The heat exchanger 48 can also include an accumulator (not shown) that is coupled to the condenser coil via interconnecting refrigerant tubing. The heat exchanger 48 is coupled to a metering device 44 via interconnecting refrigerant tubing, one or more valves, and filters 42. The metering device 44 is coupled to the heat exchanger 32 via interconnecting refrigerant tubing. In this manner a refrigerant loop is formed, where the refrigerant loop includes the evaporator coil in the heat exchanger 32, the compressor 38, the condenser coil and the accumulator in the heat exchanger 48, the metering device 44, and the interconnecting pipes, valves, and filters. It is understood that the number and configuration of interconnecting refrigerant tubing, valves, and filters shown in FIG. 2 is for exemplary purposes only and that alternative configurations are also contemplated for interconnecting the heat exchanger 32, the compressor 38, the heat exchanger 48, and the metering device 40. It is also understood that the direction of refrigerant flow can be one direction for cooling functionality (air conditioning) and the other direction for heating functionality.

An air mover 30 in the evaporator section 4 is coupled to the heat exchanger 32 to blow air over the evaporator coil assembly, and an air mover 46 in the condenser section 8 is coupled to the heat exchanger 48 to blow air over the condenser coil. A compressor controller 36 is coupled to the compressor 38. An HVAC unit controller 34 is coupled to the air mover 30, the compressor controller 36, the one or more valves such as valves 40, the metering device 44, and the air mover 46. Control signaling, indicated by "C" in FIG. 2, is transmitted between the compressor controller 36 and the compressor 38, and between the HVAC unit controller 34 and the air mover 30, the compressor controller 36, the one or more valves such as valves 40, the metering device 44, and the air mover 46. In some embodiments, the compressor controller 36 can be integrated as part of the HVAC unit controller 34. Control/diagnostic sensors 60, 62, 64, 66 can be used to sense various ambient conditions, such as temperature or humidity, which are connected back to the HVAC unit controller 34 and can be used to control the various components of the HVAC unit 12. High voltage power, such as 120 VAC, is supplied to each of the air mover 30, the compressor controller 36, and the air mover 46. High voltage power can be supplied from the compressor controller 36 to the compressor 38. High voltage power input is indicated by "H" in FIG. 2. Low voltage power is supplied to the unit controller 34. Low voltage power can be provided via wiring labeled "C". It is understood that alternative power supply configurations are also contemplated.

In some embodiments, air filters are included as part of the evaporator section 4 and the condenser section 8. Air is drawn into the evaporator section 4, such as from the room in which the HVAC is installed, directed across the evaporator coil assembly, and output from the evaporator section 4 back into the room. The air filter can be positioned at an air intake portion of the evaporator section 4 such that air is filtered prior to being blown across the evaporator coil assembly. Similarly, air is drawn into the condenser section 8, such as from outside the dwelling within which the HVAC is installed, directed across the condenser coil, and output from the condenser section 8 back outside the dwelling. The air filter can be positioned at an air intake portion of the condenser section 8 such that air is filtered prior to being blown across the condenser coil.

Figure 3:
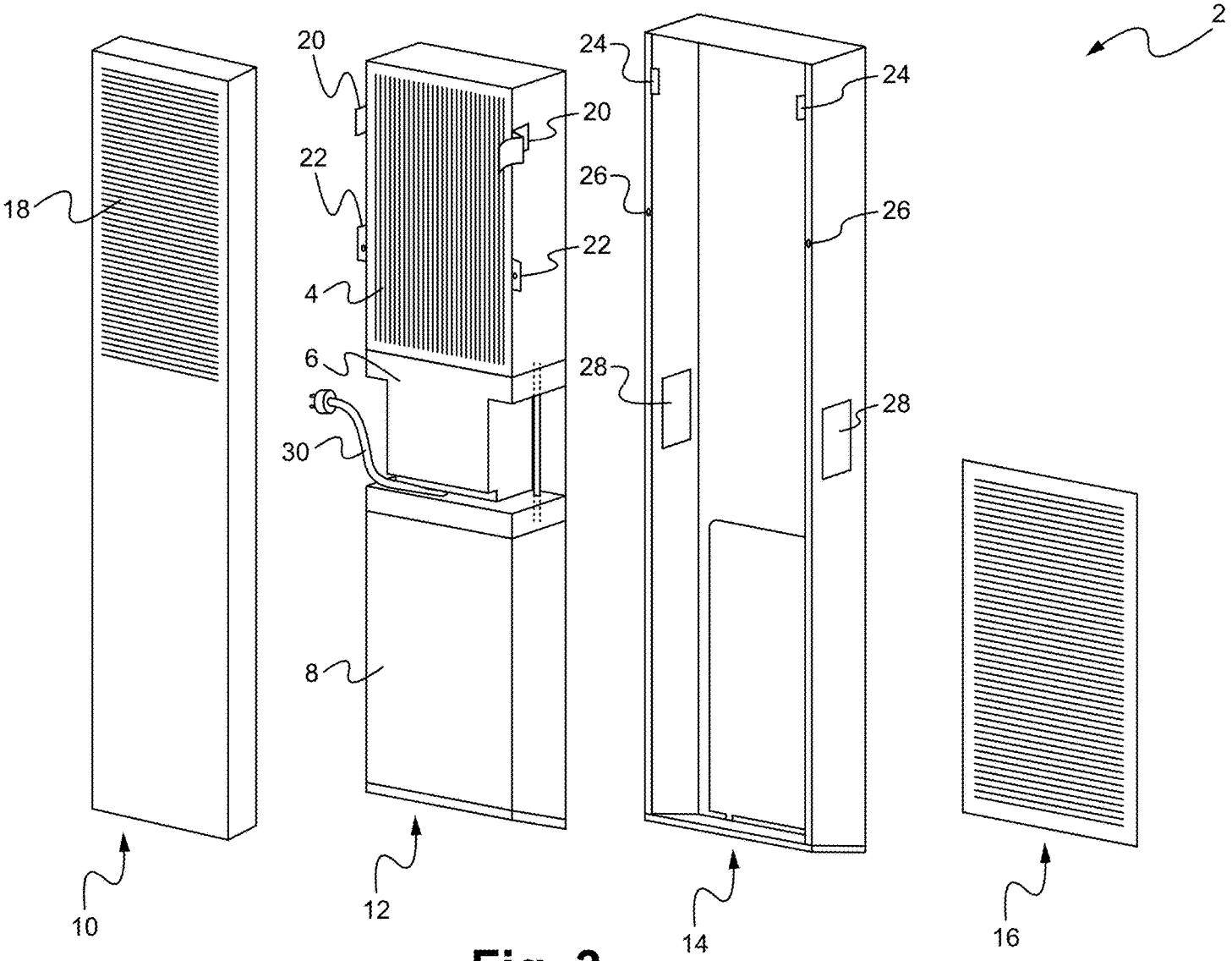
FIG. 3 illustrates an exploded view of an HVAC system according to some embodiments.
Figure 4:
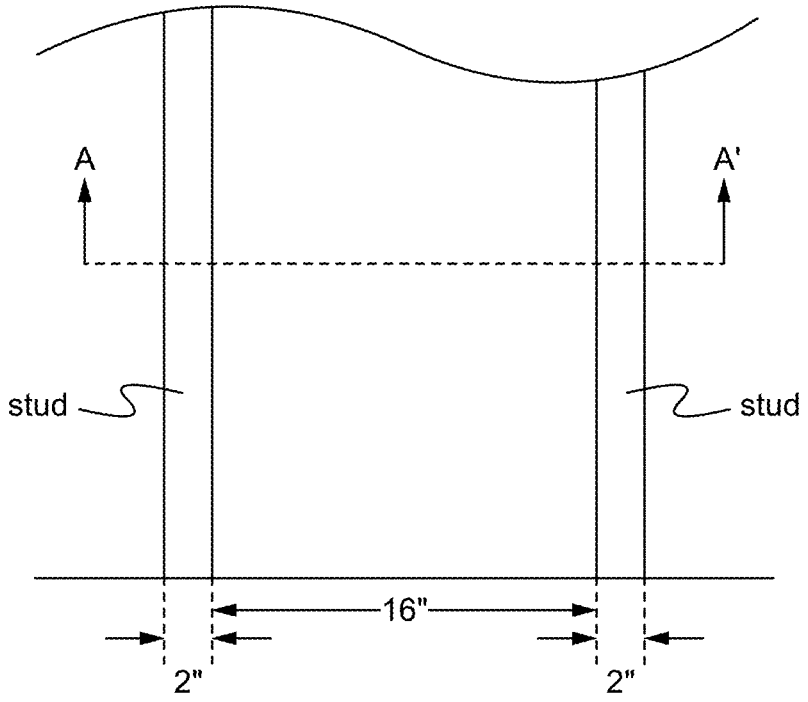
FIG. 4 illustrates an exemplary preexisting framework into which the HVAC system can be installed according to some embodiments.
Figure 5:
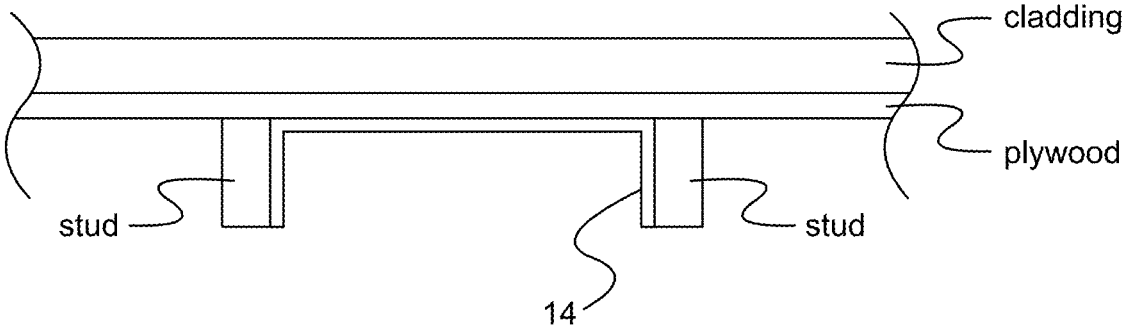
FIG. 5 illustrates a top down view of the mounting sleeve mounted in a preexisting framework of a wall according to some embodiments.

In some embodiments, the HVAC unit is an integrated single unit that includes the evaporator section, the mechanical section, and the condenser section integrated as a single piece body. In other embodiments, the HVAC unit is an assembly of distinct modular units where the evaporator section is implemented as an evaporator modular unit, the mechanical section is implemented as a mechanical modular unit, and the condenser sector is implemented as a condenser modular unit. The HVAC unit is mounted within a mounting sleeve, and an indoor grille and an outdoor grille are attached to cover exposed portions of the HVAC unit. FIG. 3 illustrates an exploded view of an HVAC system according to some embodiments. The HVAC system includes a front side access panel 10, an HVAC unit 12, a mounting sleeve 14, and a back side grille 16. The mounting sleeve 14 is configured to be mounted between preexisting framework of a dwelling, such as a room of an apartment or condominium. In an exemplary application, the mounting sleeve fits between two adjoining studs in a wall. FIG. 4 illustrates an exemplary preexisting framework into which the HVAC system can be installed according to some embodiments. The preexisting framework can be an exposed portion of a wall. As shown in FIG. 3, the exposed portion of the wall has the drywall removed from an interior side of the room, thereby exposing adjacent studs and the area in between. The area between the adjacent studs is void of insulating material, electrical wiring, plumbing, and the like so as to enable positioning and mounting of the mounting sleeve 14 within this area. The mounting sleeve 14 is sized to fit conventional framing configurations. For example, a conventional opening between adjacent studs is 16" with a depth of 6". FIG. 5 illustrates a top down view of the mounting sleeve mounted in a preexisting framework of a wall according to some embodiments. The top down view shown in FIG. 5 corresponds to the cross-section A-A' shown in FIG. 4. A back side of the area between the studs may include plywood, cladding, and/or other materials known in the art. In an exemplary configuration, a back side surface that is exposed within the area between adjacent studs is made of plywood. The mounting sleeve 14 is configured to fit within the area between adjacent studs and against the back side surface. In some embodiments, the mounting sleeve 14 is secured to the adjacent studs using screws. The mounting sleeve 14 can include holes to receive the screws, or the screws can be screwed in directly through the mounting sleeve material, forming holes as the screws are applied. In some embodiments, the mounting sleeve 14 is also secured to the back side surface of the preexisting framework in a manner similar to that of the studs. It is understood that alternative techniques can be used to secure the mounting sleeve to the preexisting framework.

In some embodiments, one or both of the adjacent studs are configured with a power outlet, such as an AC voltage wall socket, or include a hole through which electrical wiring can be strung to access a power outlet. The mounting sleeve 14 can be configured with one or more side openings, such as side openings 28 shown in FIG. 3, coincident with the power outlets on one or both of the adjacent studs. The side openings 28 enable the HVAC unit 12 to access the power outlet(s) and connect to power. In some embodiments, the HVAC 12 includes a power cord and plug 29 configured for connecting to a conventional power outlet, such as the AC voltage wall socket, which provides the high voltage power "H".

The HVAC unit 12 and the mounting sleeve 14 each include complementary mounting apparatuses for mounting the HVAC unit 12 to the mounting sleeve 14. In the exemplary configuration shown in FIG. 3, the mounting sleeve 14 includes holes 26 in the side walls and also includes flanges 24 that extend from the side walls. The HVAC unit 12 includes mounting tabs 20 configured to mate to the flanges 24 in the mounting sleeve 14. The HVAC unit 12 also includes flanges 22 with holes where screws or fasteners, such as quarter turn fasteners, can be inserted into the holes 26 of the mounting sleeve 14. The holes 26 can be screw holes for accepting screws or fasteners. It is understood that additional mounting tab/flange and/or flange/screw hole combinations can be used, or only mounting tab/flange or only flange/screw hole implementations can be used. It is further understood that alternative complementary mounting apparatuses can be used to mount the HVAC unit 12 to the mounting sleeve 14.

The front side access panel 10 can be attached after the HVAC unit 12 has been mounted and secured to the mounting sleeve 14. The back side grille 16 is attached on an exterior surface of the dwelling and can be attached either before or after the HVAC unit 12 is mounted in the mounting sleeve 14.

Figure 6:
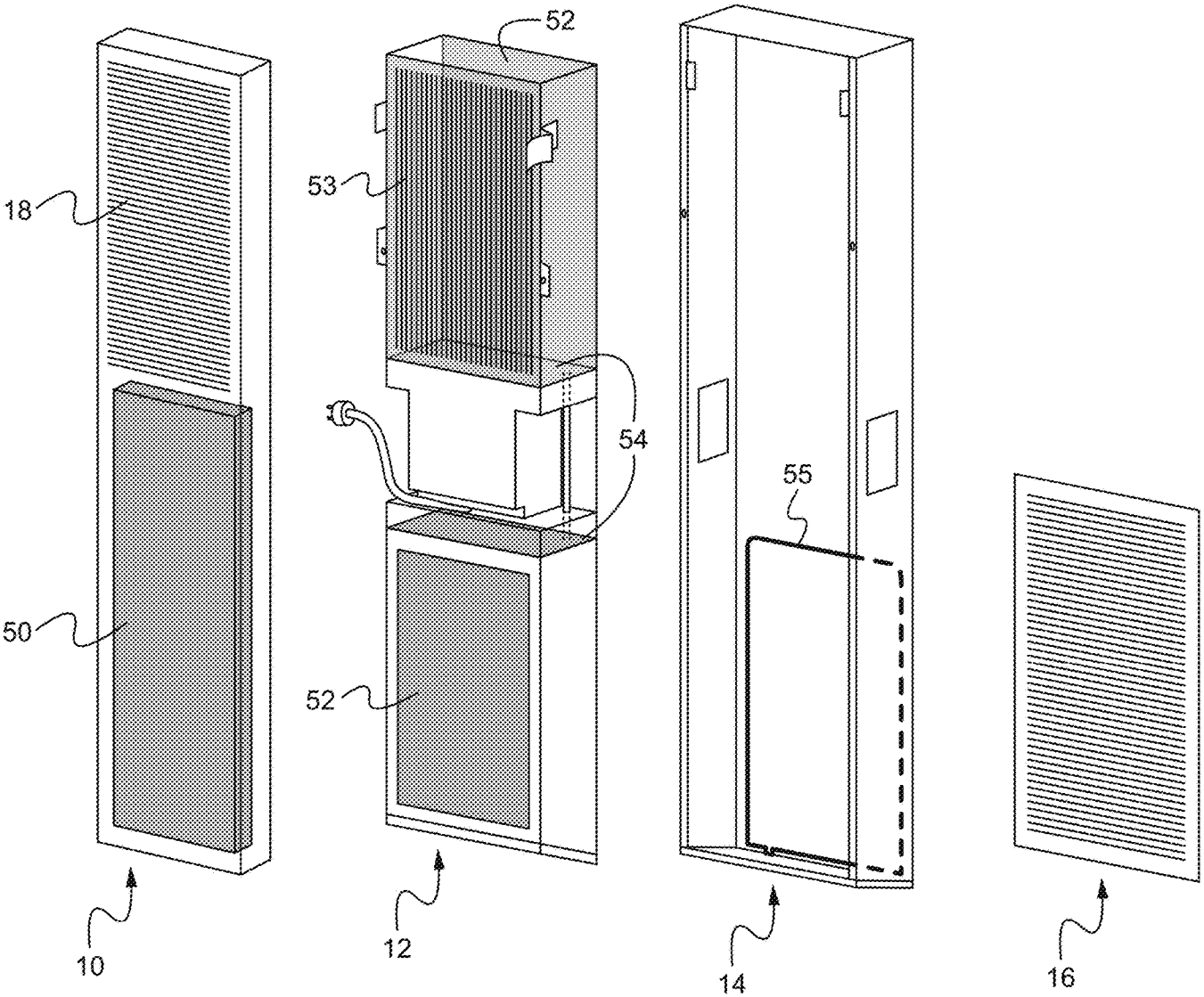
FIG. 6 illustrates an exploded view of the HVAC system including exemplary materials for providing thermal, sound, and water isolation according to some embodiments.

Various materials can be added to provide thermal, sound, and water isolation. In particular, thermal and sound resistant materials can be included to provide thermal and sound isolation of the HVAC unit from the interior dwelling. Water resistant materials can be used to manage condensate formed in the evaporator section. FIG. 6 illustrates an exploded view of the HVAC system including exemplary materials for providing thermal, sound, and water isolation according to some embodiments. A sound isolation panel 50 can be positioned on an interior surface of the front side access pane 10 without blocking the grille 18. Similar material can be positioned around or proximate the air mover 30 in the evaporate section 4 and the air mover 46 in the condenser section 8 to provide vibrational isolation. Thermal isolation panels 52 can be positioned on the back side facing surface of the evaporator section 4 and the front side facing surface of the condenser section 8. A thermal isolation trim 53 can be positioned around a front side facing perimeter of the evaporator section 4 without blocking the grille 18.

Condensate forms in the evaporator section 4 and may form on the outer surfaces of the evaporator section 4 and portions of the mounting sleeve 14 in contact with the evaporator section 4. Moisture barriers are positioned to prevent condensate from entering the mechanical section 6. A moisture barrier 54 can be positioned between the evaporator section 4 and the mechanical section 6. Additionally, or alternatively, a moisture barrier can be positioned on the inside bottom surface of the evaporator section 4. Another moisture barrier 54 also can be positioned between the mechanical section 6 and the condenser section 8. A moisture barrier trim 55 also can be positioned around a perimeter of the back side facing grille 16 without blocking the grille. The moisture barriers 54 and moisture barrier trim 55 can be made of any type of moisture resistance material in a variety of different forms, such as a spray, film, or separate panel of material applied to the surfaces of the evaporator section 4 and/or the mechanical section 6.

Additionally, or alternatively, the HVAC system 2 can be configured to collect and displace condensate. The evaporator section 4 and the mounting sleeve 14 can be configured such that condensate can collect on the interior side surfaces of the mounting sleeve 14 and flow down the interior side surfaces to an interior bottom surface of the mounting sleeve. In those configurations where the interior back surface of the mounting sleeve 14 does not include thermal or acoustic isolation materials, such as in FIG. 6, condensate also can collect on the interior back surface of the mounting sleeve 14 and flow down the interior back surface to the interior bottom surface of the mounting sleeve. In some embodiments, the bottom surface of the mounting sleeve 14 is sloped to collect condensate at a bottom most portion. A drain tube can be attached at the bottom surface of the mounting sleeve 14 to drain out the collected condensate. The drain tube can be directed through a floorboard. Additionally, or alternatively, a drain tube can extend through the back side facing grille 16 to drain out the collected condensate. In some embodiments, a condensate collection tray with one or more drain holes can be positioned at the bottom of the mounting sleeve 14, and the drain tubes can be connected to the condensate collection tray.

Condensate within the evaporator section 4 drains to a bottom surface of the evaporator section 4. One or more drain holes or drain tubes can be positioned at the bottom surface of the evaporator section 4 to enable condensate to drain out of the evaporator section 4. In some embodiments, the condensate drains out of the evaporator section 4 and down the interior side surface of the mounting sleeve 14. In some embodiments, condensate output from the evaporator section 4 is directed via drain tubes to the bottom surface of the mounting sleeve 14. In other embodiments, the condensate is enabled to drain across the condenser coil in the condenser section 8 via gravity.

Figure 7:
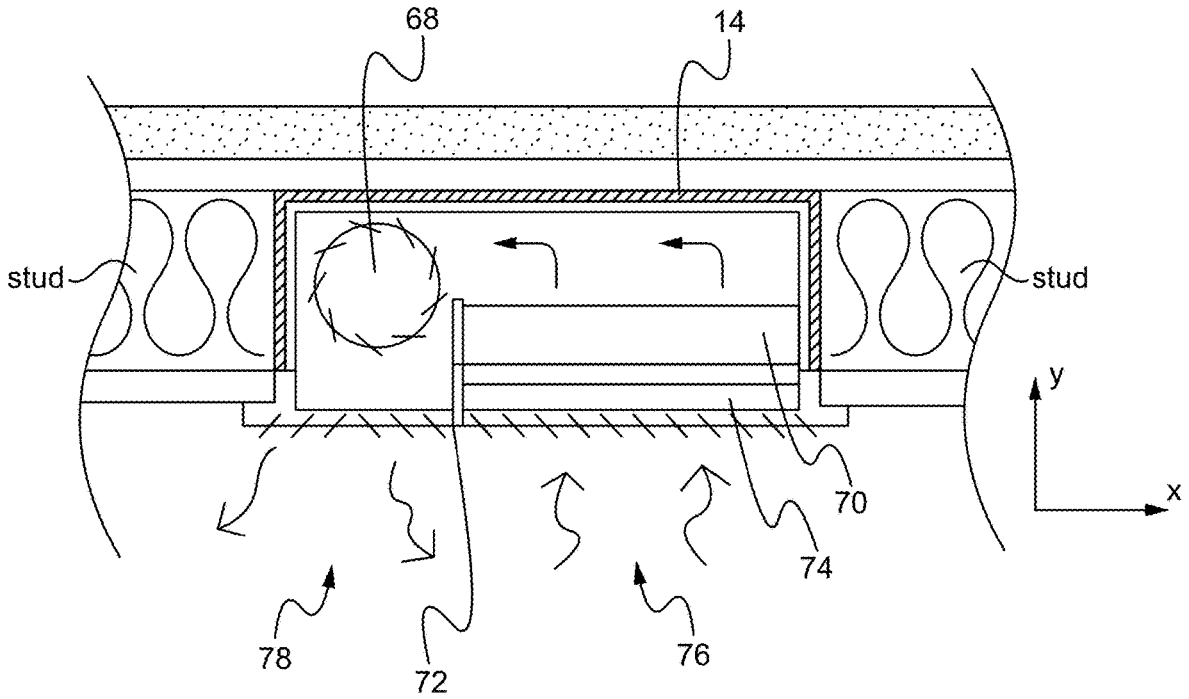
FIG. 7 illustrates a cut-out top down view of an evaporator section installed in a preexisting framework and having a lateral configuration according to some embodiments.

The physical positioning, relative alignment, and dimensions of each of the individual components in each of the evaporator section 4 and the condenser section 8 can vary according to numerous different configurations and applications. In some embodiments, the air mover is positioned to a lateral side of the heat exchanger, i.e. horizontal to the heat exchanger, in either or both of the evaporator section 4 and the condenser section 8. This is referred to as a lateral configuration. FIG. 7 illustrates a cut-out top down view of an evaporator section installed in a preexisting framework and having a lateral configuration according to some embodiments. The mounting sleeve 14 is mounted to the side walls (studs) and the back wall of the preexisting framework. In the lateral configuration, an air mover 68 is positioned laterally adjacent to a heat exchanger 70. The air mover 68 can be any type of conventional fan including, but not limited to, an axial fan, a centrifugal fan, or a cross flow fan. An axial fan has blades that force air to move parallel to the shaft about which the blades rotate. A centrifugal fan, also called a radial fan, a squirrel cage fan, or a scroll fan, has a moving component called an impeller that consists of a central shaft about which a set of blades that form a spiral, or ribs, are positioned. A centrifugal fan blows air at right angles to the intake of the fan. The impeller rotates, causing air to enter the fan near the shaft and move perpendicularly from the shaft to an output opening in the scroll-shaped fan casing. The cross flow fan, also called a tangential fan or a tubular fan, is typically long in relation to the diameter. The cross flow fan uses an impeller with forward-curved blades, placed in a housing consisting of a rear wall and a vortex wall. Unlike a centrifugal fan, the main air flow moves transversely across the impeller, passing the blades twice. In some embodiments, the air mover 68 and the heat exchanger 70 each extend substantially an entire height, or nearly the entire height, of the evaporator section 4. It is understood that air movers and heat exchangers can be used that have heights that are less than the height of the evaporator section 4.

Input air 76 from the interior of the dwelling is drawn into the evaporator section 4 by the air mover 68 through a first side of a front side grille 72. The input air 76 passes through a filter 74 and across the heat exchanger 70, such as an evaporator coil assembly, and is directed via an air plenum back out the evaporator section 4 through a second side of the front side grille 72 as output air 78. In the exemplary configuration shown in FIG. 7, the first side of the front side grille 72 is the right hand side through which the input air 76 enters, and the second side of the front side grille 72 is the left hand side through which the output air 78 exits. It is understood that these sides can be reversed. The air mover 68, the heat exchanger 70, and the front side grille 72 are analogous to the previously described air mover, heat exchanger, and front side grille of the evaporator section. In some embodiments, turning vanes can be positioned adjacently behind the heat exchanger 70 within the evaporator section 4 to redirect airflow toward the air mover 68, which reduces air pressure drop, and improves or smooths airflow across the heat exchanger. The front side grille 72 can also include curved blades which reduces noise and airflow pressure drop.

Figure 8:
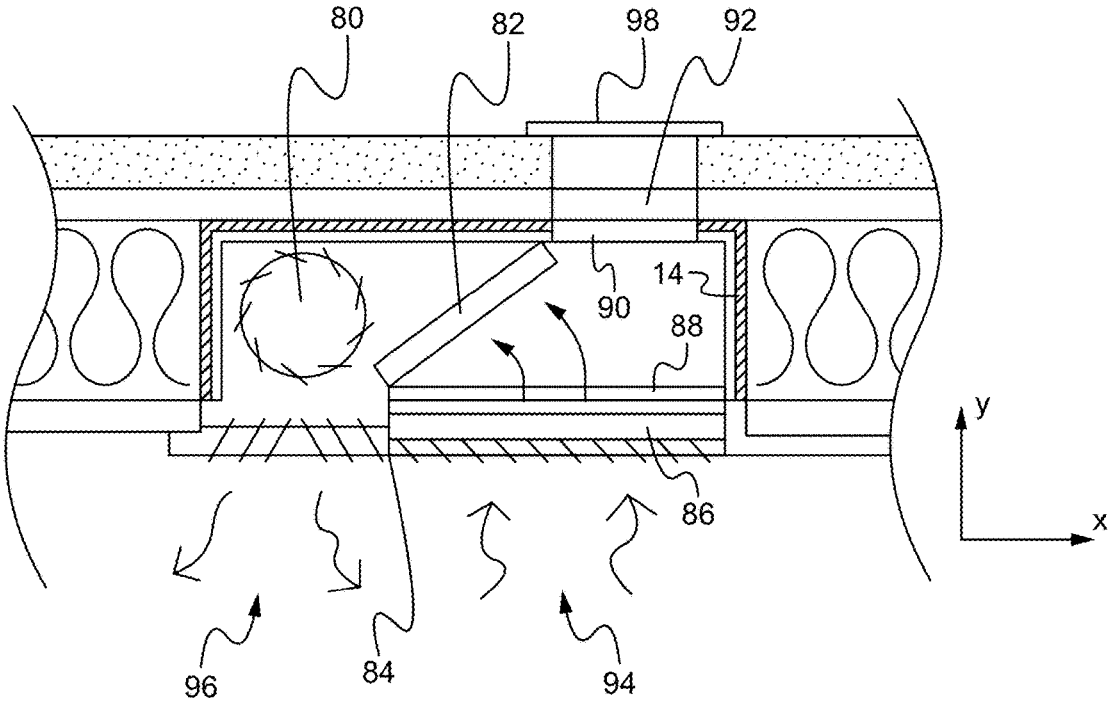
FIG. 8 illustrates a cut-out top down view of an evaporator section installed in a preexisting framework and having a lateral configuration and outdoor ventilation according to some embodiments.

In the above described configurations, the evaporator section has indoor ventilation, via the front side opening in the mounting sleeve and the front side grille, but no outdoor ventilation. In other embodiments, the evaporator section, mounting sleeve, and dwelling wall can be configured to include outdoor ventilation. FIG. 8 illustrates a cut-out top down view of an evaporator section installed in a preexisting framework and having a lateral configuration and outdoor ventilation according to some embodiments. The mounting sleeve 14 is mounted to the side walls (studs) and the back wall of the preexisting framework. In the lateral configuration, an air mover 80 is positioned laterally adjacent to a heat exchanger 82. The air mover 80 can be any type of conventional fan including, but not limited to, an axial fan, a centrifugal fan, or a cross flow fan. In some embodiments, the air mover 80 and the heat exchanger 82 each extend substantially an entire height, or nearly the entire height, of the evaporator section 4. It is understood that air movers and heat exchangers can be used that have heights that are less than the height of the evaporator section 4.

Input air 94 from the interior of the dwelling is drawn into the evaporator section 4 by the air mover 80 through a first side of a front side grille 84. The input air 94 passes through an air filter 86 and across the heat exchanger 82, such as an evaporator coil assembly, and is directed via an air plenum back out the evaporator section 4 through a second side of the front side grille 84 as output air 96. In the exemplary configuration shown in FIG. 8, the first side of the front side grille 72 is the right hand side through which the input air 76 enters, and the second side of the front side grille 72 is the left hand side through which the output air 78 exits. It is understood that these sides can be reversed. The air mover 80, the heat exchanger 82, and the front side grille 84 are analogous to the previously described air mover, the heat exchanger, and the front side grille of the evaporator section. Outdoor ventilation 98 is provided at the back side of the evaporator section 4 via a back side opening in the mounting sleeve 14 and the back wall of the dwelling. The opening is covered on the exterior of the dwelling by a grille (not shown). A balancing damper 92 and an air filter 90 are positioned at the back side opening, and a balancing damper 88 is positioned proximate the air filter 86. The balancing damper 88 can be an automated balancing damper under the control of the HVAC unit controller 34 (FIG. 2). Baffles in the balancing dampers 88, 92 enable mixing of the input air 94 with ambient air from the exterior, which enables control of the air temperature of the air passing across the heat exchanger 82. In some embodiments, the air temperature is controlled to be greater than a threshold temperature. The front side grille 84 can include curved blades which reduces noise and airflow pressure drop. In some embodiments, such as that shown in FIG. 8, the heat exchanger 82 is angled relative to horizontal (X-axis). The angled orientation increases surface area relative to a horizontally oriented heat exchanger, such as the heat exchanger 70 shown in FIG. 7. It is understood that the angled heat exchanger also can be applied in the lateral configuration shown in FIG. 7, and that the horizontally oriented heat exchanger shown in FIG. 7 can be used in the lateral configuration shown in FIG. 8.

Figure 9:
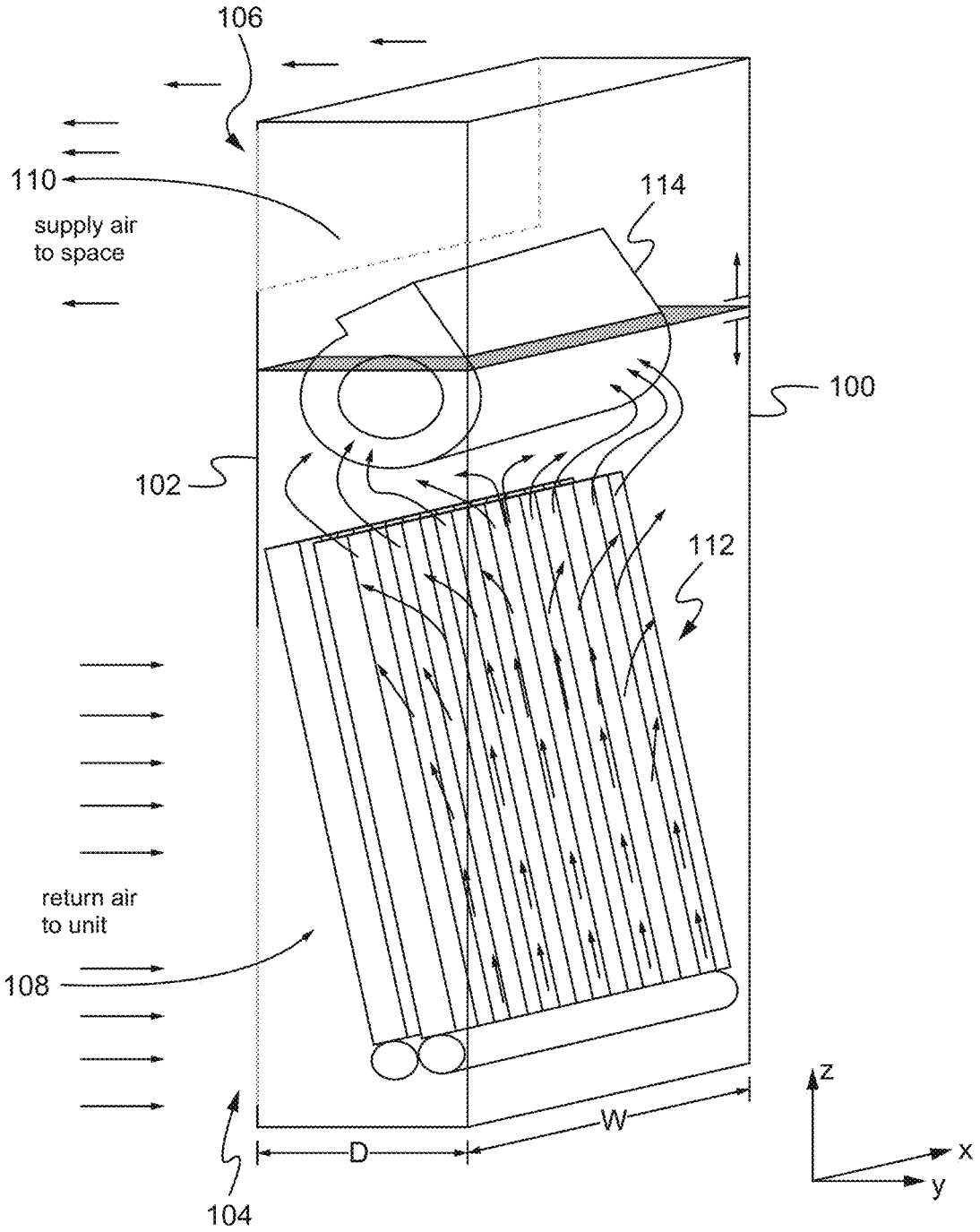
FIG. 9 illustrates a side perspective view of an evaporator section installed in a preexisting framework and having a stacked configuration according to some embodiments.

Alternatively to a lateral configuration, a stacked configuration can be used where the air mover is positioned above or below the heat exchanger, i.e. vertical to the heat exchanger, in either or both of the evaporator section 4 and the condenser section 8. FIG. 9 illustrates a side perspective view of an evaporator section installed in a preexisting framework and having a stacked configuration according to some embodiments. The mounting sleeve (not shown) is mounted to the side walls (studs) and the back wall of the preexisting framework and the HVAC unit including the evaporator section is mounted within the mounting sleeve as previously described. A simplified version of the evaporator section is shown in FIG. 9 to better illustrate the relative positions of a heat exchanger 112 and an air mover 114 relative to each other and to a housing 100 of the evaporator section. In the stacked configuration shown in FIG. 9, the air mover 114 is positioned above the heat exchanger 112. Alternatively, the heat exchanger can be positioned above the air mover. The air mover 114 can be any type of conventional fan including, but not limited to, an axial fan, a centrifugal fan, or a cross flow fan. In the exemplary configuration shown in FIG. 9, the air mover is a centrifugal fan with air input into the fan at its ends. In this configuration, a width (Y-direction) of the centrifugal fan does not extend an entire width of the evaporator section so an to enable air to input the centrifugal fan at its ends. In other embodiments, the air mover 114 extends an width length, or nearly the entire width, of the evaporator section.

Input air 108 from the interior of the dwelling is drawn into the evaporator section 4 by the air mover 114 through a first side of a front side grille 102. The input air 108 passes through an air filter (not shown) and through the heat exchanger 112 and the air mover 114, and is directed via an air plenum back out the evaporator section 4 through a second side of the front side grille 102 as output air 110. In the exemplary configuration shown in FIG. 9, the first side of the front side grille 102 is a bottom side 104 through which the input air 108 enters, and the second side of the front side grille 102 is a top side 106 through which the output air 110 exits. It is understood that these sides can be reversed. The air mover 114, the heat exchanger 112, and the front side grille 102 are analogous to the previously described air mover, heat exchanger, and front side grille of the evaporator section. The front side grille 84 includes Louvers, which can be straight, angles, or curved.

The heat exchanger 112 is angled relative to the depth (Y-direction) and the height (Z-direction). In other words, the heat exchanger 112 is positioned at a non-parallel angle relative to a height of the housing 100 and is positioned at a non-parallel angle relative to a depth of the housing 100. The width of the heat exchanger is positioned parallel to th width of the housing 100. A bottom of the heat exchanger 112 is positioned against a back wall of the housing 100, and a top of the heat exchanger is positioned against a front wall of the housing 100, which may or may not be the front side grille 102. Such tilted positioning of the heat exchanger 112 relative to the housing 100 forces the input air 108 to flow through, instead of around, the heat exchanger 112.

In an exemplary configuration, the heat exchanger 112 is tilted relative to the height axis (Z-direction) of the evaporator section at an angle of approximately 18 degrees (arctan 18/6), which corresponds to a 6 inch depth (Y-direction) of the evaporator section and an 18 inch height of the heat exchanger 112. For the heat exchanger to re-direct the horizontal air (input air 108) vertically, the angle of the arctan (6/18)=72 degrees from normal to the plane of the heat exchanger. These angles can be adjusted within a range that accounts for an evaporator section depth in the range of 2 to 12 inches and the height of the heat exchanger ranging from 12 to 48 inches.

Figure 10:
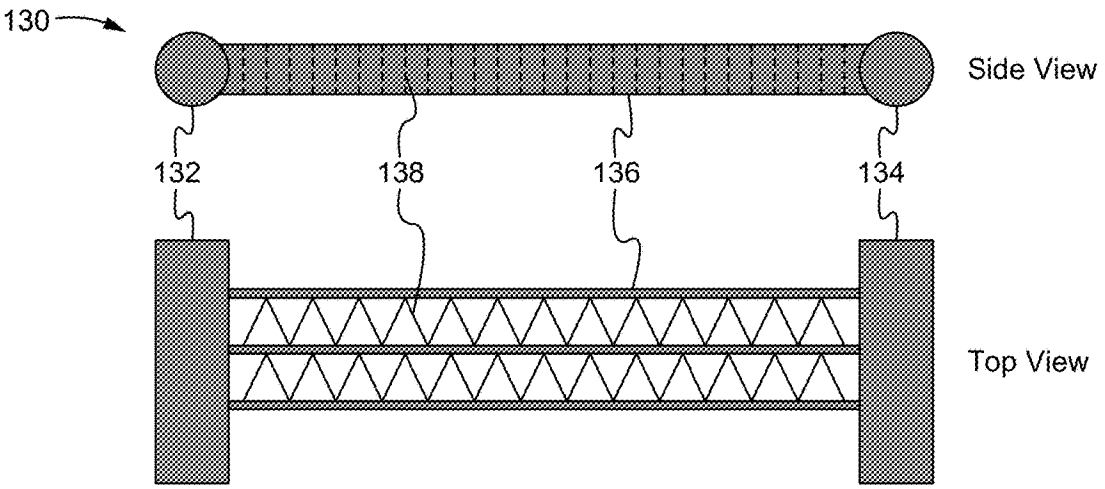
FIG. 10 illustrates a side view and a top down view of a heat exchanger having a coil and fin assembly according to some embodiments.

In some embodiments, the heat exchanger 112 is configured as a coil and fin assembly. FIG. 10 illustrates a side view and a top down view of a heat exchanger having a coil and fin assembly according to some embodiments. The coil and fin assembly 130 includes a first header 132 and a second header 134, microchannel tubes 136, and fins 138. Each header 132, 134 can be configured to input or output refrigerant from refrigerant tubing within the evaporator section, or can be configured as returns to the microchannel tubes 136. Refrigerant enters one of the headers, such as header 134, and is directed through the microchannel tubes 136 to the other header, such as header 132. The refrigerant can either exit the heat exchanger via the second header, or the refrigerant can be cycled back to the first header by the second header and microchannel tubes. In this manner, the refrigerant can be cycled back and forth through the heat exchanger 112 according to specific design considerations. The microchannel tubes 136 are mechanically attached to the fins 138. In some embodiments, the fins 138 are made of a thermally conductive material. In the case of operating as an air conditioning unit, the fins 138 are cooled by the refrigerant passing through the microchannel tubes 136. Air passing over the fins 138 is cooled and output through the output opening 106 via the air mover 114. In the exemplary configuration shown in the top down view of FIG. 10, the coil and fin assembly 130 includes two rows of fins 138 and three rows of microchannel tubes 136. It is understood that the more or less rows of fins and microchannel tubes can be used. It is also understood that more than one coil and fin assembly 130 can be used to form the heat exchanger 112. For example, the heat exchanger 112 shown in FIG. 9 includes two coil and fin assemblies. In the case of multiple coil and fin assemblies, the coil and fin assemblies can be attached together to allow refrigerant flow between the assemblies. Alternatively, the multiple coil and fin assemblies can have independent refrigerant flow with separate connections to refrigerant tubing within the evaporator section.

Figure 11:
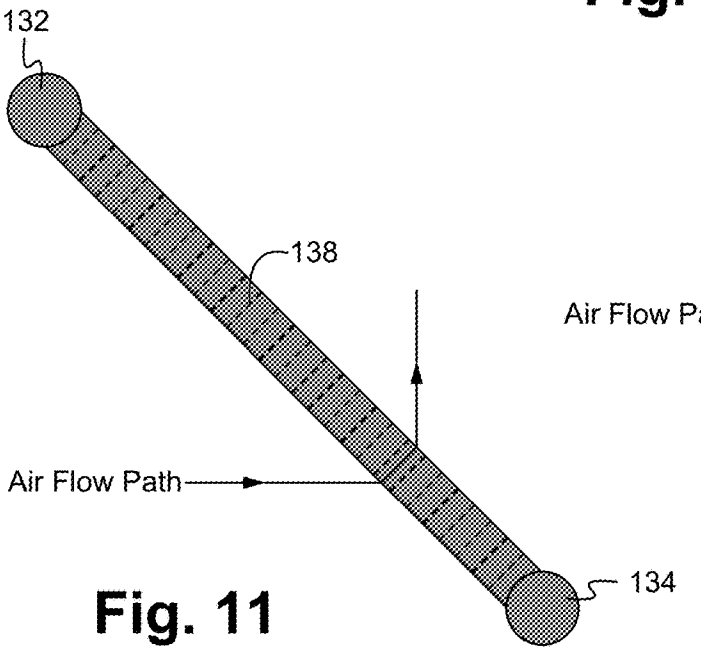
FIG. 11 illustrates the coil and fin assembly of FIG. 10 shown in a tilted position according to some embodiments.

The configuration of the fins 138 relative to the lengthwise direction of the coil and fin assembly 130 has a symmetrical configuration, as shown in the top down view in FIG. 10, and as identified by the parallel lines labeled as 138 in the side view in FIG. 10. When the coil and fin assembly 130 is placed in the evaporator section, the coil and fin assembly 130 has a tilted position relative to the Z-direction. FIG. 11 illustrates the coil and fin assembly of FIG. 10 shown in a tilted position according to some embodiments. An airflow path shows the input air passing through and out of the coil and fin assembly 130 with the fins 138 having the symmetrical configuration.

Figure 12:
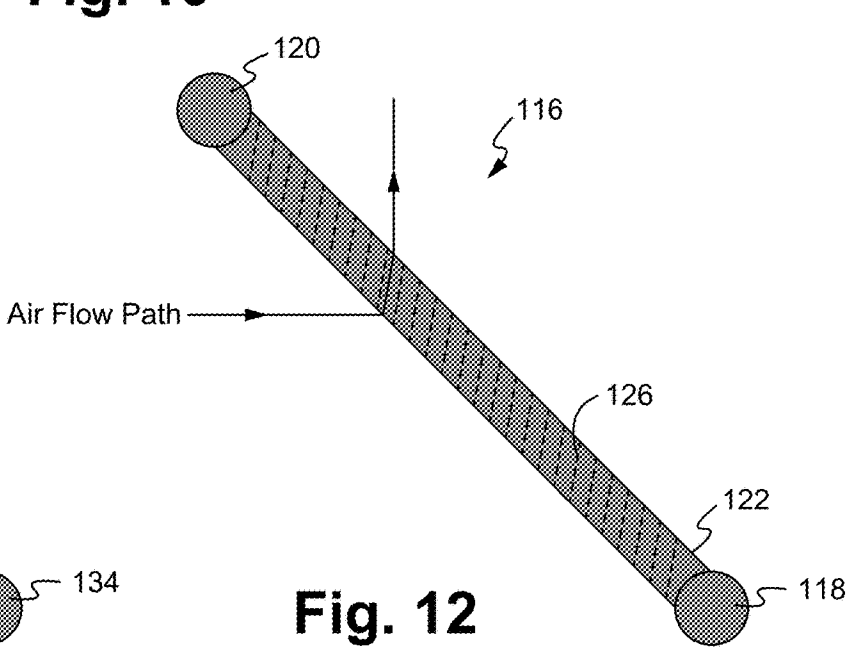
FIG. 12 illustrates a side view of a coil and fin assembly with fins having an asymmetrical configuration according to some embodiments.

Air flow through and air pressure drop within the evaporator section can be improved by proper design and orientation of the fins within the heat exchanger. In some embodiments, the configuration of the fins has an asymmetrical configuration. FIG. 12 illustrates a side view of a coil and fin assembly with fins having an asymmetrical configuration according to some embodiments. The coil and fin assembly 116 includes a first header 120 and a second header 118, microchannel tubes 122, and fins 126. The coil and fin assembly 116 is configured and operates similarly as the coil and fin assembly 130 in FIG. 10 except the fins 126 in the coil and fin assembly 116 have an asymmetrical configuration. In this asymmetrical configuration, the air flow direction across the fins 126 is more vertical (Z-direction) and closer to the Z-direction necessary for the air flow to reach the air mover 114 (FIG. 9), which reduces the air pressure drop within the evaporator section.

In general, a coil and fin assembly can be configured according to a variety of different design parameters. Examples of different design parameters include, but are not limited to, a fin angle (symmetry) a fin pitch, a coil configuration, and a coil assembly construction. In some embodiments, the fin pitch is in the range of 16 to 22 fins per inch. The coils can be configured as a single row slab (FIG. 10), a two row slab (FIG. 9), an A-shaped coil, an N-shaped coil, or a V-shaped coil. Materials used to make the coil and fin assembly can include, but are not limited to, a copper tube and aluminum fin, or an aluminum tube and an aluminum fin.

Similar lateral or stacked configurations can be used for the condenser section 8, except instead of the input air being input from and output to an interior of the dwelling, air is input from and output to an exterior of the dwelling via a back side grille, such as the back side grille 16. It is understood that such a condenser section can also be configured with interior ventilation to enable mixing of air, such as used in the configuration shown in FIG. 8.

The present application has been described in terms of specific embodiments incorporating details to facilitate the understanding of the principles of construction and operation of the HVAC system. Many of the components shown and described in the various figures can be interchanged to achieve the results necessary, and this description should be read to encompass such interchange as well. As such, references herein to specific embodiments and details thereof are not intended to limit the scope of the claims appended hereto. It will be apparent to those skilled in the art that modifications can be made to the embodiments chosen for illustration without departing from the spirit and scope of the application.

What is claimed is:

1. A heat exchanging system, comprising:

a housing comprising opposing front and back walls, wherein the front wall comprises an input air opening and an output air opening;

a heat exchanger positioned within the housing, wherein the heat exchanger is configured to transfer heat between air flowing by the heat exchanger and fluid flowing within the heat exchanger, wherein the heat exchanger is tilted from vertical such that a top of the heat exchanger is tilted towards the front wall and a bottom of the heat exchanger is tilted towards the back wall, and wherein the heat exchanger includes a coil and fin assembly comprising:

a first header, a second header, one or more microchannel tubes configured to direct fluid flow from the first header to the second header, and a plurality of fins mechanically connected to the one or more microchannel tubes, wherein each of the plurality of fins is asymmetrically aligned with the one or more microchannel tubes, wherein according to the asymmetrical alignment, air enters the heat exchanger at a first angle to the plurality of fins, such that the first angle is greater than a second angle between air inflow direction and an axis perpendicular to the one or more microchannel tubes, and wherein the air passes through the heat exchanger at a non-perpendicular angle to the one or more microchannel tubes.

2. The heat exchanging system of claim 1, further comprising a mounting sleeve configured to fit within a preexisting framework of a dwelling.

3. The heat exchanging system of claim 2, wherein the housing is positioned entirely within a volume enclosed by the mounting sleeve.

4. The heat exchanging system of claim 1, wherein the housing has a depth of between 2 and 6 inches.

5. The heat exchanging system of claim 1, further comprising interconnecting refrigerant tubing coupled to the heat exchanger.

6. The heat exchanging system of claim 1, wherein the top of the heat exchanger is positioned against the front wall of the housing and the bottom of the heat exchanger is positioned against the back wall of the housing.

7. The heat exchanging system of claim 1, further comprising:

a mechanical section positioned within the housing;

a moisture barrier positioned between the heat exchanger and the mechanical section, wherein the moisture barrier is configured to prevent condensate from entering into the mechanical section; and an air mover positioned within the housing and aligned adjacent to the heat exchanger along a lengthwise direction of the heat exchanger.

8. The heat exchanging system of claim 1, wherein each of the one or more microchannel tubes has opposing airflow input and output surfaces, and wherein the plurality of fins extend non-perpendicularly from the airflow input surfaces to the airflow output surfaces.

9. A heat exchanging system, comprising:

a housing having an input air opening and an output air opening;

a heat exchanger positioned within the housing, wherein the heat exchanger is configured to transfer heat between air flowing by the heat exchanger and fluid flowing within the heat exchanger, wherein the heat exchanger includes a coil and fin assembly comprising:

a first header, a second header, one or more microchannel tubes configured to direct fluid flow from the first header to the second header, and a plurality of fins mechanically connected to the one or more microchannel tubes, wherein each of the plurality of fins is asymmetrically aligned with the one or more microchannel tubes, wherein according to the asymmetrical alignment, air enters the heat exchanger at a first angle to the plurality of fins, such that the first angle is greater than a second angle between air inflow direction and an axis perpendicular to the one or more microchannel tubes, and wherein the air passes through the heat exchanger at a non-perpendicular angle to the one or more microchannel tubes.

10. The heat exchanging system of claim 9, wherein a top of the heat exchanger is positioned against a front wall of the housing and a bottom of the heat exchanger is positioned against a back wall of the housing.

11. The heat exchanging system of claim 9, further comprising a mounting sleeve configured to fit within a preexisting framework of a dwelling.

12. The heat exchanging system of claim 11, wherein the housing is positioned entirely within a volume enclosed by the mounting sleeve.

13. The heat exchanging system of claim 11, wherein the mounting sleeve includes a back side opening in a back side wall, wherein the heat exchanging system further comprises a first balancing damper positioned within the back side opening, and wherein the heat exchanging system further comprises a second balancing damper positioned within the housing and proximate to the input air opening.

14. The heat exchanging system of claim 9, wherein the housing has a depth of between 2 and 6 inches.

15. The heat exchanging system of claim 9, further comprising interconnecting refrigerant tubing coupled to the heat exchanger.

16. The heat exchanging system of claim 9, further comprising:

a mechanical section positioned within the housing;

a moisture barrier positioned between the heat exchanger and the mechanical section, wherein the moisture barrier is configured to prevent condensate from entering into the mechanical section; and an air mover positioned within the housing and aligned adjacent to the heat exchanger along a lengthwise direction of the heat exchanger.

* * * * *